US006807961B2

(12) United States Patent
Burrows

(10) Patent No.: US 6,807,961 B2
(45) Date of Patent: Oct. 26, 2004

(54) GRANITE AND MARBLE NIPPING TOOL

(76) Inventor: Ken Barton Burrows, 1938 E. Cobblestone Rd., Springville, UT (US) 84663

( * ) Notice: Subject to any disclaimer, the term of this patent is extended or adjusted under 35 U.S.C. 154(b) by 88 days.

(21) Appl. No.: 10/389,562

(22) Filed: Mar. 17, 2003

(65) Prior Publication Data

US 2004/0182380 A1 Sep. 23, 2004

(51) Int. Cl.[7] ..... B26B 17/02
(52) U.S. Cl. ..... 125/23; 30/192; 30/252
(58) Field of Search ..... 125/23; 30/191, 30/192, 245, 252; 72/409.11; 81/355

(56) References Cited

U.S. PATENT DOCUMENTS

| | | | | |
|---|---|---|---|---|
| 63,721 A | | 4/1867 | Handy | |
| 157,610 A | | 12/1874 | King | |
| 298,587 A | | 5/1884 | Jenkes | |
| 351,339 A | * | 10/1886 | Pullman | 30/192 |
| 547,101 A | * | 10/1895 | Williams | 30/192 |
| 596,066 A | | 12/1897 | Helwig | |
| 710,182 A | | 9/1902 | Carolus | |
| D50,029 S | | 12/1916 | Porter | |
| 1,613,480 A | | 1/1927 | Porter | |
| 2,677,177 A | | 5/1954 | Herckelbout | |
| 4,130,938 A | * | 12/1978 | Uhlmann | 30/192 |
| 4,910,870 A | | 3/1990 | Chang | |
| 5,365,915 A | | 11/1994 | Yu | |
| 5,898,998 A | | 5/1999 | Deville | |
| 6,226,874 B1 | | 5/2001 | Jansson | |
| D472,119 S | * | 3/2003 | Burrows | D8/52 |

* cited by examiner

*Primary Examiner*—Joseph J. Hail, III
*Assistant Examiner*—Anthony Ojini
(74) *Attorney, Agent, or Firm*—M. Reid Russell

(57) ABSTRACT

A marble and granite nipping tool that includes a pair of blade support plates as blade mounting ends whereto nipping blades having opposing nipping edges are releasably mounted and provides for setting a selected opposing nipping edge spacing to allow a use of the tool on different widths or thicknesses of marble and granite slabs, for removing or nipping off edge sections thereof. The tool includes a linkage consisting of lever arms secured at lever arm ends to the blade support plates undersurfaces that connect, in turn, through a pivot coupling to scissoring arms that and operated to provide a mechanical advantage to multiply a closure force directed through the scissoring arms and linkage and into the blade support plates for facilitating the removal of marble and granite edge sections. Which scissoring arms can, in one embodiment, be manually closed by an operator moving ends of the arms together, and, in another embodiment, by operation of a an automated scissoring arm closure arrangement.

11 Claims, 8 Drawing Sheets

GRANITE AND MARBLE NIPPING TOOL

BACKGROUND OF THE INVENTION

1. Field of the Invention

This invention relates to tools for use in is removal of chips or sections of an edge of a granite or marble counter or sink top for providing a decorative edge surface.

2. Prior Art

Nipping tools for use in shaping an edge of a section of tile, or the like, are, of course, well known and examples of such devices are shown in U.S. Patents to: Jencks U.S. Pat. No. 298,587 and to Yang Yu U.S. Pat. No. 5,365,915, with other nipping tools shown in Uhlmann U.S. Pat. No. 4,130, 938 and Herckelbout, U.S. Pat. No. 2,677,177, that are for, respectively, nipping animal hooves and as cutting pliers. None of which tools provide, as does the invention, for adjustable positioning of the jaws of the tool relative to opposing cutting edges for controlling the spacing between which cutting edges.

Additional to providing a capability for adjustment of the spacing distance between the edges of the opposing blades, the invention includes lever arms that provide a mechanical advantage to an operator to close the blades together. Such lever arm arrangements for closing blades together, have been employed for cutting through objects such as nails, bolts or the like, but have not been applied to nipping tools. Some examples of such cutting tools where the handles thereof are arranged to afford an operator with a mechanical advantage to move the tool handles together are shown in Porter, U.S. Design Pat. No. 50,029 and in Handy, U.S. Pat. No. 63,721; to Carolus, U.S. Pat. No. 710,182; to King, U.S. Pat. No. 157,610; to Porter, U.S. Pat. No. 1,613,480; to Chang, U.S. Pat. No. 4,910,870; to Deville, U.S. Pat. No. 5,898,998 and to Jansson, U.S. Pat. No. 6,226,874, and an example of a bolt cutter that, in lieu of manually operated scissoring arms, employs a pneumatic or hydraulic operated piston arrangement operated to urge scissor arms together to close tool jaws, is shown in a Helwig, U.S. Pat. No. 596,066.

Where, per the above cited art, scissoring arms that are closed together for closing opposing jaws for cutting a bolt, rod, or the like, are well know, as are nippers with fixed cutting edges to cutting tile, or the like. None of the art, however, show a granite or marble edge nipping tool with movable opposing jaws for pinching or nipping off sections of different thicknesses of marble or granite sink and counter tops. Nor does the earlier art show nipping or chipping devices where the opposing cutting edges spacing distance is adjustable and which set distance can be maintained in place for nipping or chipping a selected width of granite or marble counter or sink top to provide a desired finished decorative edge surface.

SUMMARY OF THE INVENTION

It is a principal object of the present invention to provide a nipping and chipping tool that is suitable for removing edge sections of a granite or marble sink or counter top, providing a decorative edge surface.

Another object of the present invention is to provide a nipping and chipping tool that is suitable for use with granite or marble counter or sink tops of different widths.

Another object of the present invention is to provide a nipping and chipping tool that takes the place of what has formerly been a manual operation involving an operator working with a hammer and chisel to chip off sections of an edge of a section of marble or granite, for forming a decorative edge.

Still another object of the present invention is to provide a chipping and nipping tool that includes scissoring arms that are linked to opposing jaws such that, when the arms are manually or mechanically operated to close together, the opposing jaws will also be closed together.

Still another object of the present invention is to provide a linkage between the scissoring arms and opposing jaws where a mechanical advantage exists such that a force of closing the scissoring arms together is increased at the opposing jaws, closing the jaws together.

Still another object of the present invention is to provide a nipping and chipping tool that is easily and efficiently operated to provide a controlled removal of sections of a granite or marble counter or sink top edge.

The invention in a nipping and cutting tool that is for chipping or nipping off sections of a marble or granite counter top edge to provide a decorative surface thereto, and is an improvement over earlier practices an operator, using a hammer and chisel, chips off sections of a marble or granite counter top edge.

The invention provides a pair of opposing blade support plates that each receive a blade fitted thereto that if formed to allow for individual blade movement relative to one another for altering blade edge spacing distance. The selected blade edge spacing to provide a nipping action to a particular thickness of granite or marble edge, allowing the tool to be used on different widths or thicknesses of marble or granite counter top, producing a desired decorative edge. Further, the opposing blades are operated through a linkage and include scissoring arms whereby, an operator, manually or with a pneumatic or hydraulic arrangement, urges a pair of scissoring arms together. With which scissoring arm together movement provides a mechanical advantage to the applied force to urge the blades together at a sufficient force to penetrate the granite or marble counter top edge and bottom surfaces, nipping a section therefrom.

DESCRIPTION OF THE DRAWINGS

In the drawings that illustrate that which is presently regarded as the best mode for carrying out the invention.

DETAILED DESCRIPTION

Heretofore, marble or granite counter and sink top edges have been manually chipped, as by a skilled operator using a hammer and chisel, to form a decorative rough or chipped counter or sink top edge. In such operation, even by a skilled operator, a significant amount of time is required and mistakes are often made by such operator who chips or chisels off a greater section or chip off of an edge, have often resulted in damage that is difficult or cannot be repaired. The invention shown herein is in a tool for use by even a marginally trained worked who, with careful blade edge positioning, can remove only a desired amount of marble or granite edge. Which edge section removal is thereby carefully controlled and can be accomplished in a much shorter period of time than was possible by an operator using a hammer and chisel.

Figure 1:
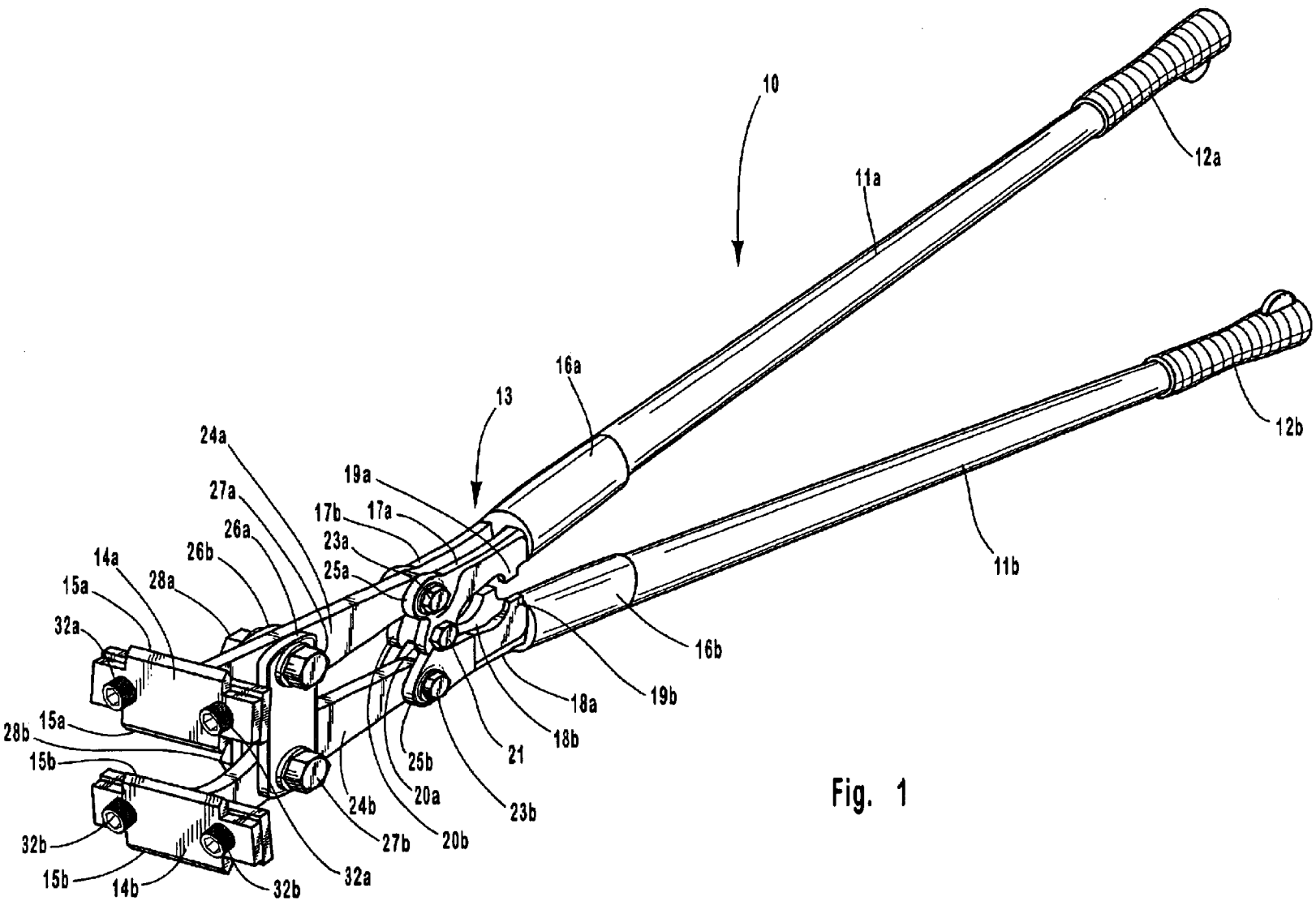
FIG. 1 is a top elevation perspective view taken from a forward end of a manually operated marble and granite nipping and chipping tool of the invention showing tool scissoring arms spread apart and are connected through a linkage such that, when the scissoring arms are closed towards one another, the opposing nipping and chipping blades are also closed together, nipping or shearing off portions of an edge of a section of marble or granite.
Figure 2:
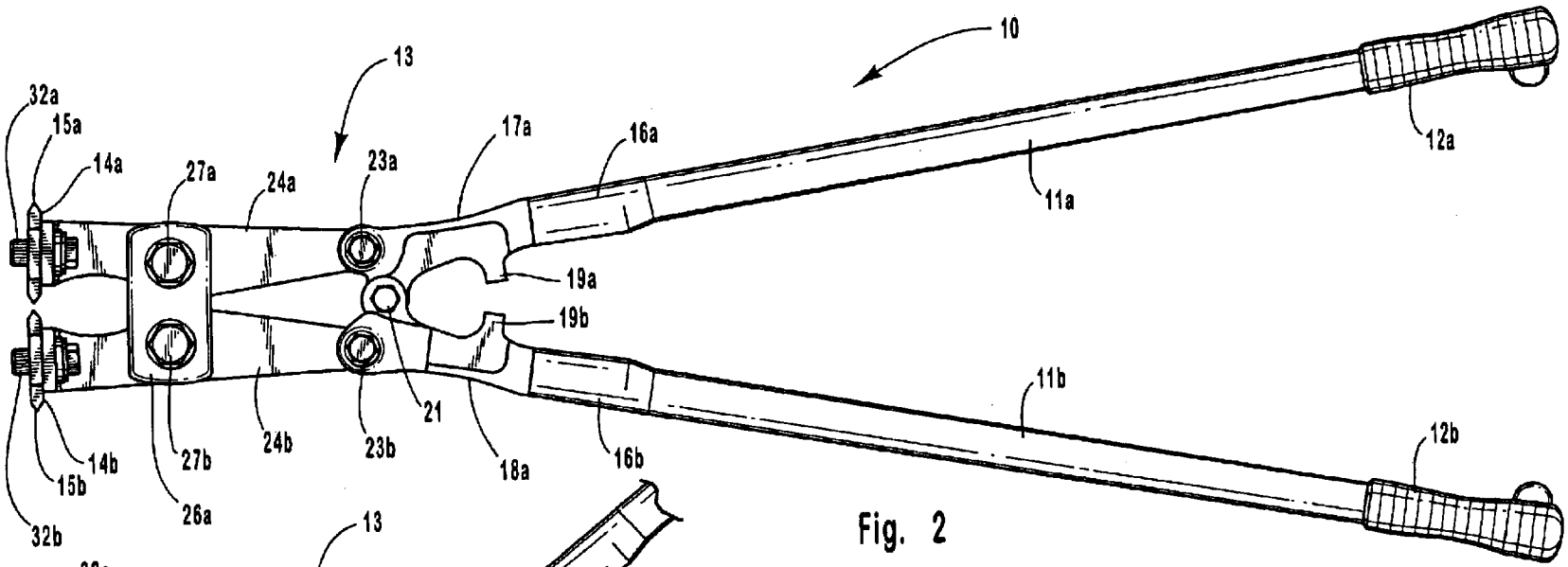
FIG. 2 is a side elevation view of the tool of FIG. 1, a rear elevation view being a mirror image thereof.
Figure 3B:
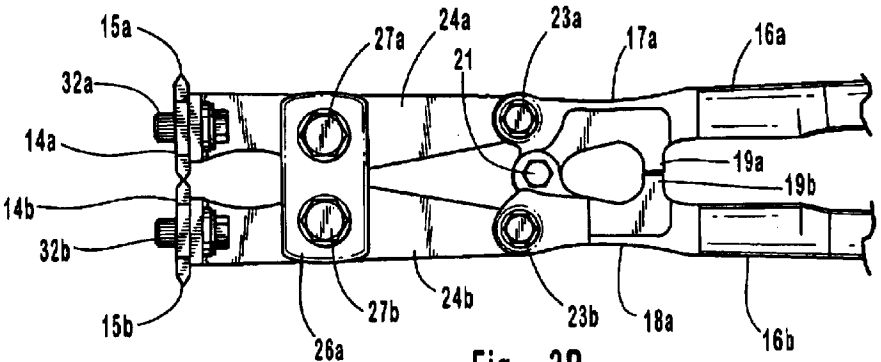
FIG. 3B is a view like that of FIG. 3A except the sections of the scissoring arms are shown as having been closed together, also closing together the opposing edges of the nipping and chipping blades.
Figure 3A:
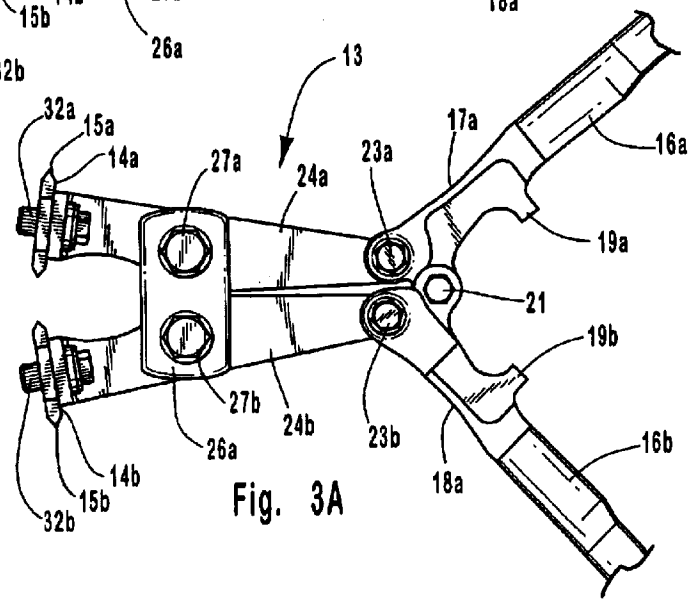
FIG. 3A is a side elevation view of a forward section of the tool of FIG. 2.
Figure 4:
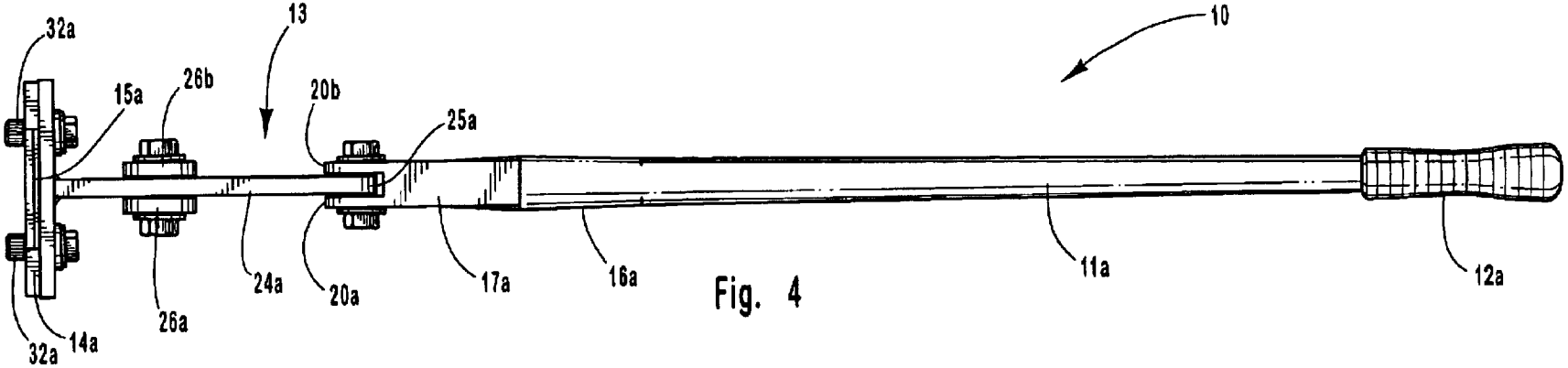
FIG. 4 is a top plan view of the tool of FIG. 1, a bottom plan view being a mirror image thereof.
Figure 6:
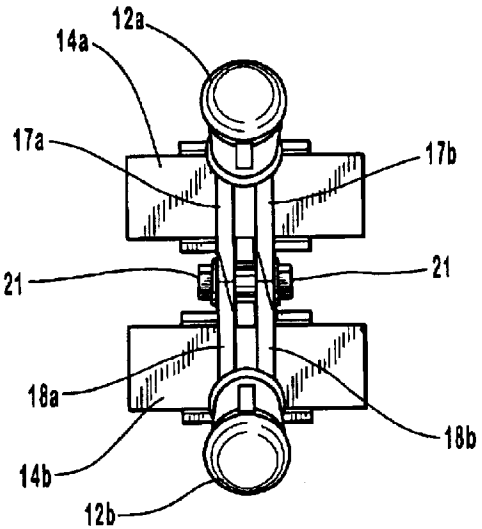
FIG. 6 is a rear end view of the tool of FIG. 2 showing the scissoring arms ends spread apart
Figure 5:
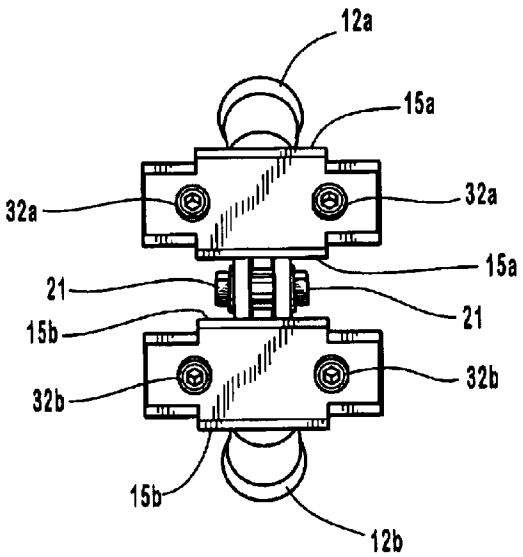
FIG. 5 is a forward end view of the tool of FIG. 2 showing the opposing blades opened apart.

FIG. 1 shows a top elevation perspective view of a marble and granite nipping tool 10 that is for manual operation by an operator who, with their hands gripping individual grip ends 12*a* and 12*b* that are fitted onto lower ends of scissoring arms 11*a* and 11*b*, moves the arm lower ends together. Which together movement of scissoring arms 11*a* and 11*b* grips 12*a* and 12*b* is transferred through a linkage 13 to close together opposing blade edges 15*a* and 15*b* of nipping blades 14*a* and 14*b*, as set out below.

Figure 7:
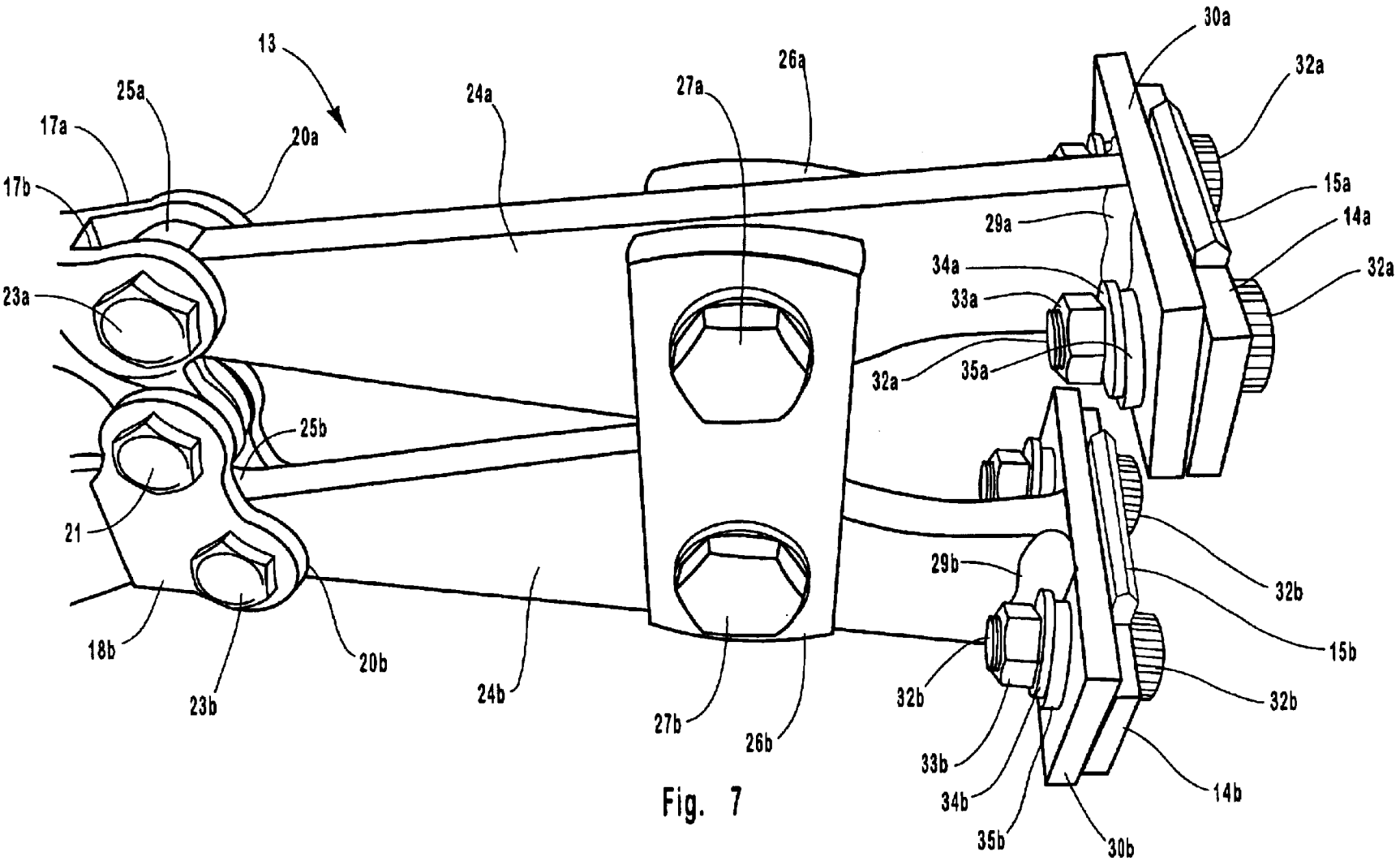
FIG. 7 is an enlarged perspective view taken from the side and behind a jaw end at the top or forward end of the tool of FIG. 1.

Shown in FIGS. 1 through 7, and best in FIG. 7, the linkage 13 includes upper end caps 16*a* and 16*b* that are fitted over top ends of each of the scissoring arms 11*a* and 11*b*, that each connect to a pair of parallel leverage bars 17*a* and 17*b* and 18*a* and 18*b*, respectively. The leverage bars 17*a* and 17*b* and 18*a* and 18*b* align with one another and each includes a blade stop, with blade stops 19*a* and 19*b* extending inwardly from leverage bars 17*b* and 18*b*, respectively. The respective blade stops engage, at their outer edges, to block travel together of the scissoring arms 11*a* and 11*b*, with, it should be understood, the leverage bars 17*a* and 18*a* also including like opposing blade stops forward from the leverage bars 17*a* and 17*b* and 18*a* and 18*b* ends. The leverage bars 17*b* and 18*a* forward ends are, formed, respectively, into cranks or levers 20*a* and 20*b*, and the crank or lever 20*a* includes a first pivot hole that aligns with the axis of the scissoring arm 11*a* and a second pivot hole is centered between the arms 11*a* and 11*b*. The crank or lever 20*b* includes a first pivot hole that is aligned with the axis of the scissoring arm 11*b* and with a second pivot hole centered between the arms 11*a* and 11*b*. The respective second pivot holes of cranks or levers 20*a* and 20*b* are fitted with a pivot bolt 21 that allows the cranks or levers 20*a* and 20*b* second pivot holes to move up and down as the scissoring arms are moved together and apart. The leverage bars 17*a* and 18*b* forward ends are formed, respectively, into pivot ends 22*a* and 22*b* that each align with first pivot hole of the cranks or levers 20*a* and 20*b* and received coupling pivot bolts 23*a* and 23*b*, respectively, fitted therethrough, that bolt through and couple to stem ends 25*a* and 25*b* of nipping lever arms 24*a* and 24*b*, respectively. So arranged, with the scissoring arms 11*a* and 11*b* spread apart, as shown in FIGS. 1, 2, 3A and 7, the crank or levers 20*a* and 20*b* second pivot holes wherethrough the pivot bolt 21 is fitted are at a lowest point relative to the scissoring arms. With, as the scissoring arms 11*a* and 11*b* are moved together, shown in FIG. 3B, the pivot bolt 21 is elevated, moving the leverage bars 17*a* and 18*b* first pivot holes wherethrough bolts 23*a* and 23*b* are fitted, apart to, in turn spread the stem ends 25*a* and 25*b* of the nipping lever arms 24*a* and 24*b* apart.

The nipping lever arms 24*a* and 24*b*, at their upper portions, include front and rear straps 26*a* and 26*b*, respectively, that extend across and are linked to the respective nipping lever arms 24*a* and 24*b* by bolts 27*a* and 27*b* that have nuts 28*a* and 28*b* turned over threaded ends thereof after passage through aligned holes formed through mid-sections of the nipper lever arms, forming pivot couplings. So arranged, closure of the scissoring arms 11*a* and 11*b* is transmitted through the leverage bars 17*a* and 18*b* and through pivots 27*a* and 27*b* to close jaw mounting ends 29*a* and 29*b* of which leverage bars together, as set out below.

As set out above, closure together of the scissoring arms 11*a* and 11*b* is ultimately transferred through the leverage bars 17*b* and 18*a* into the crank ends 20*a* and 20*b* that connect, respectively, to stem ends 25*a* and 25*b* at first pivot holes that receive pivot bolts 23*a* and 23*b* fitted therethrough. So arranged, a mechanical advantage is provided to an operator closing together the scissoring arms 11*a* and 11*b* by the distance between the arms grips 12*a* and 12*b* and the pivot bolts, greatly increasing the force the operator can apply to close the scissoring arms together that is, in turn, transferred into the crank ends 20*a* and 20*b* and thence into the crank second pivot holes that receive the pivot bolt 21. The pivot bolt 21 and crank ends wherethrough the second pivot holes are formed thereby moves axially from the attitude shown in FIG. 3A, where the scissoring arms 11*a* and 11*b* are spread apart, upwardly towards the jaw mounting ends 29*a* and 29*b*. With that pivot forward travel, in turn, spreading apart the stem ends 25*a* and 25*b* of the nipper lever arms 24*a* and 24*b*, to, and acts through, pivots 27*a* and 27*b* that are fitted through straps 26*a* and 26*b* and the nipper lever arms 24*a* and 24*b* sandwiched therebetween. The upper portions of the nipper lever arms 24*a* and 24*b* are thereby closed together, also closing together the jaw mounting ends 29*a* and 29*b*.

Figure 7A:
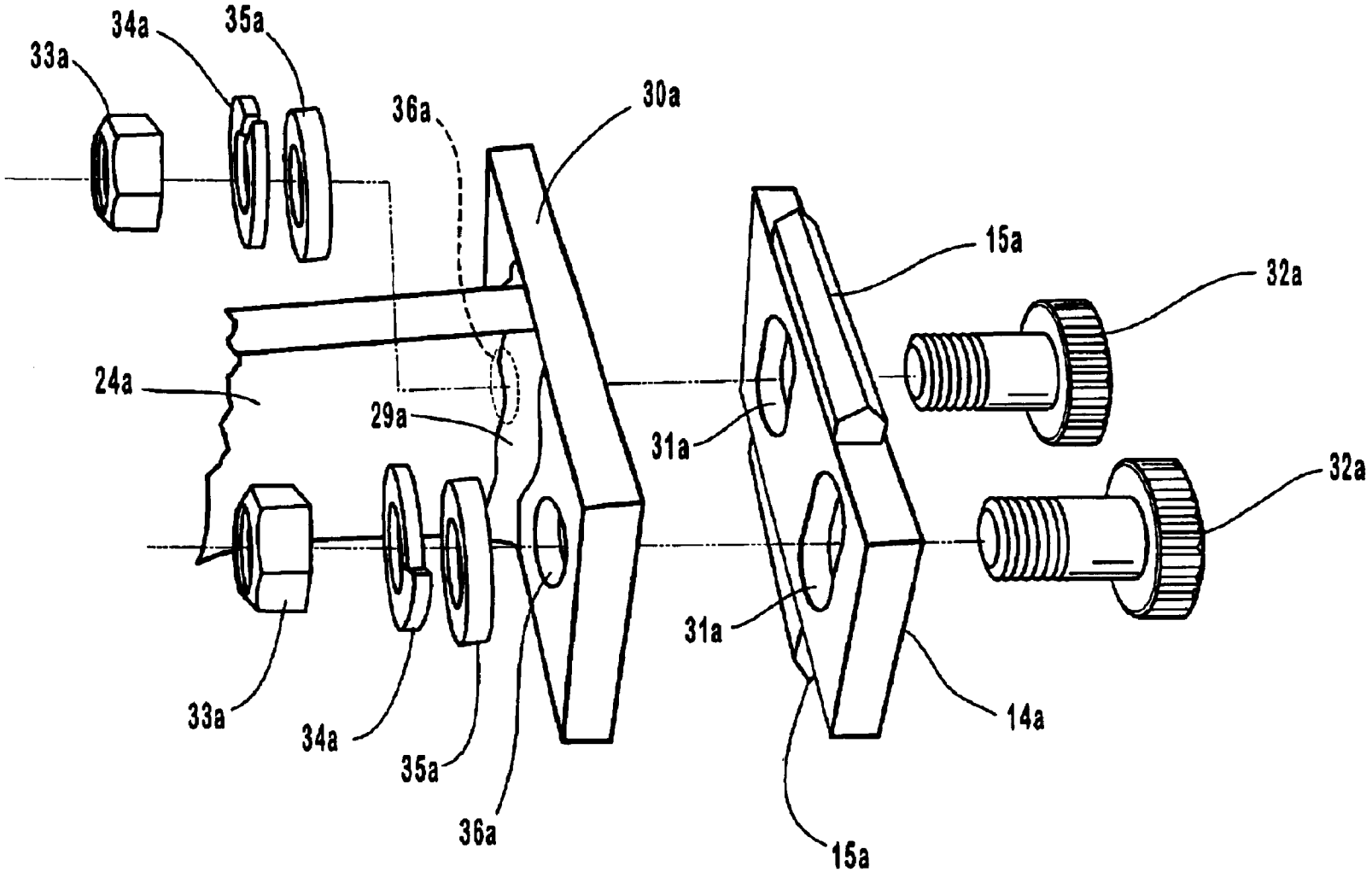
FIG. 7A is an exploded view of one of the blade support plates of the jaw end showing the blade and blade mounting nut and bolt exploded therefrom.
Figure 8:
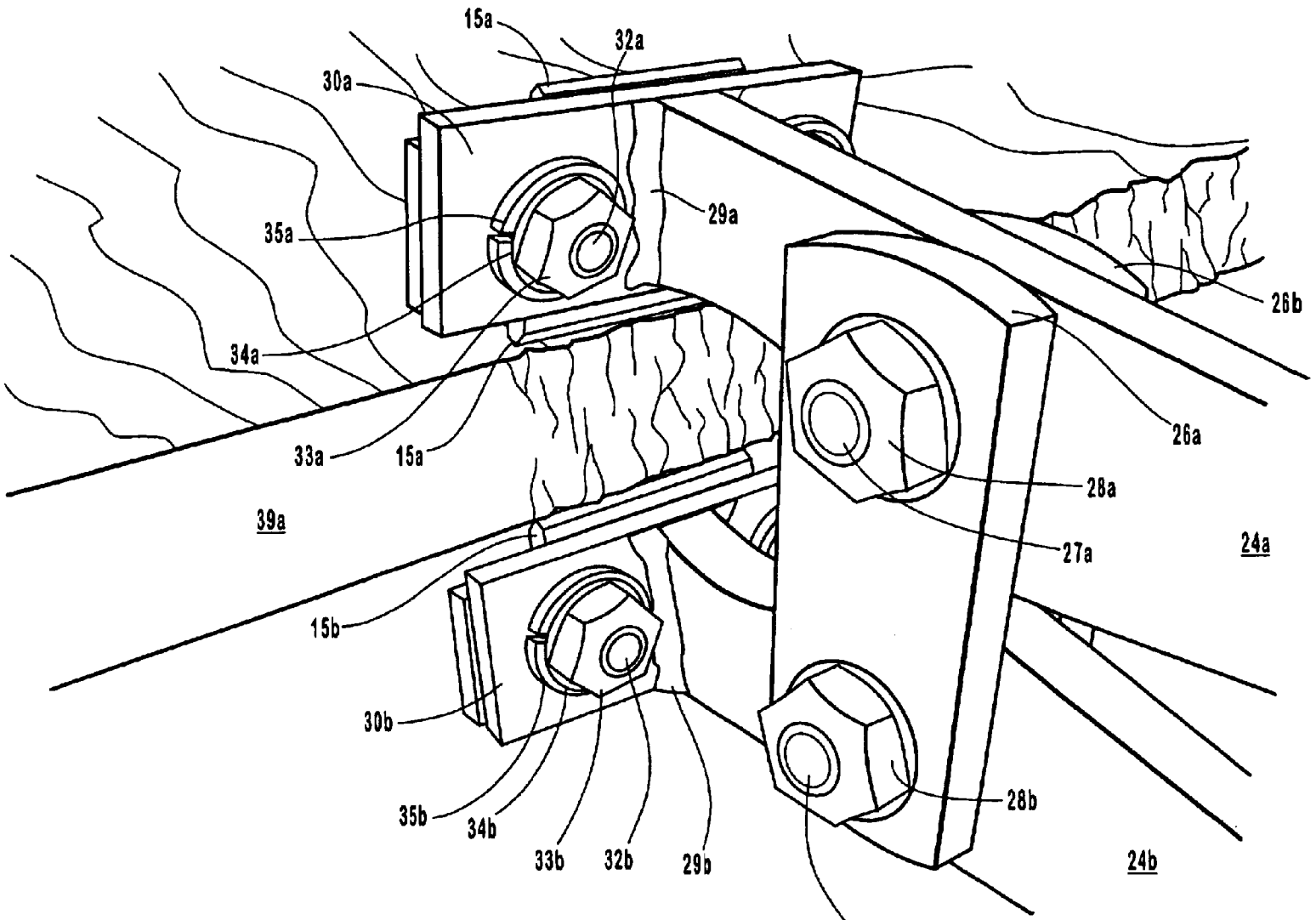
FIG. 8 is an enlarged view of the blades of FIG. 7 shown being closed together to nip or chip off a portion of an edge of a section of a granite or marble counter top.
Figure 9:
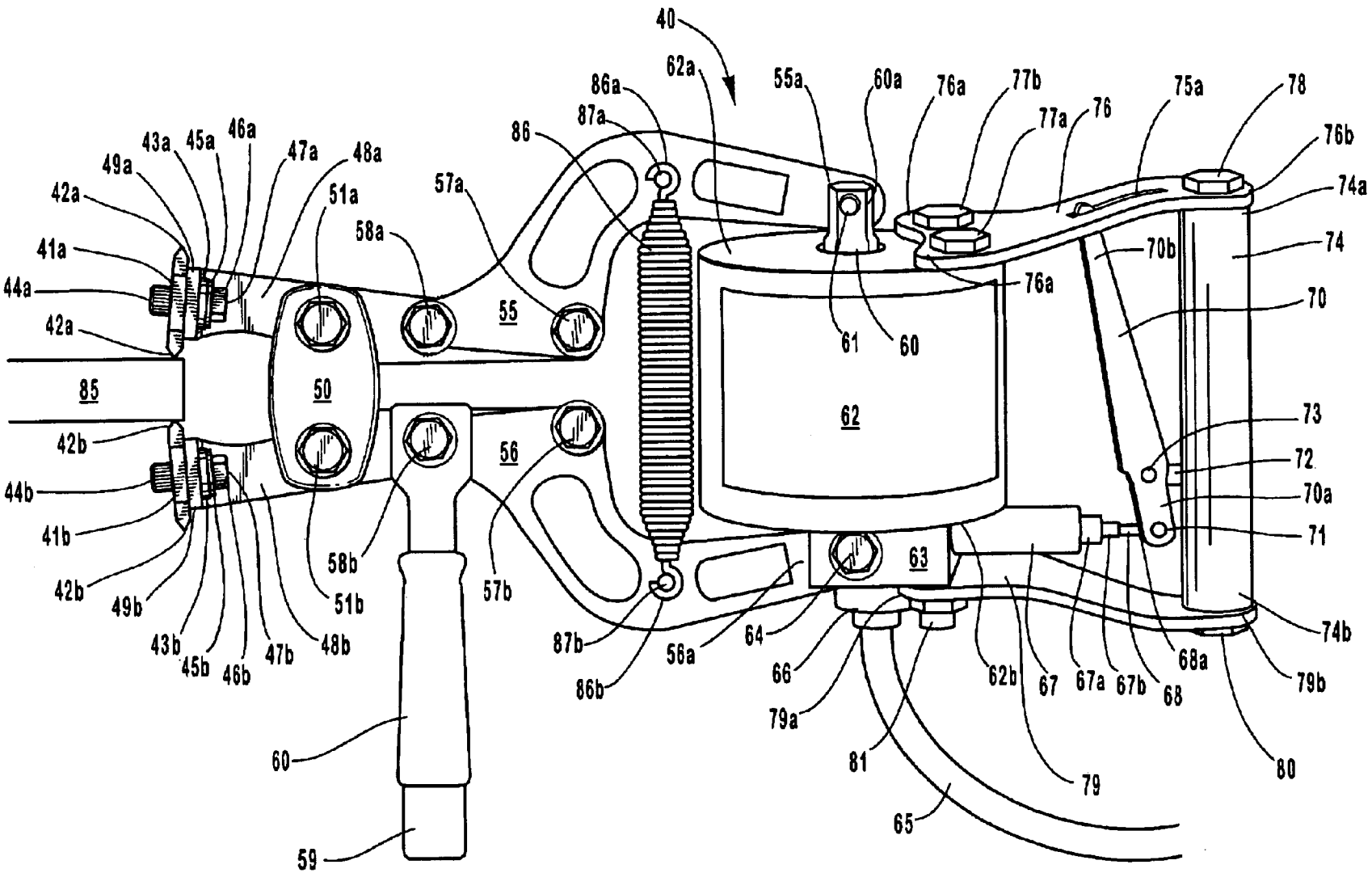
FIG. 9 shows a side elevation view of a mechanically operated marble and granite nipping and chipping tool of the invention, showing a pneumatically operated piston arrangement that is controlled by a trigger to pass air under pressure into a cylinder, extending a piston rod out of one cylinder end, to urge tool scissoring arms apart and connect through pivots to nipping blade support plates that include spaced apart nipping blades shown fitted over an edge of a section of marble or granite.
Figure 10:
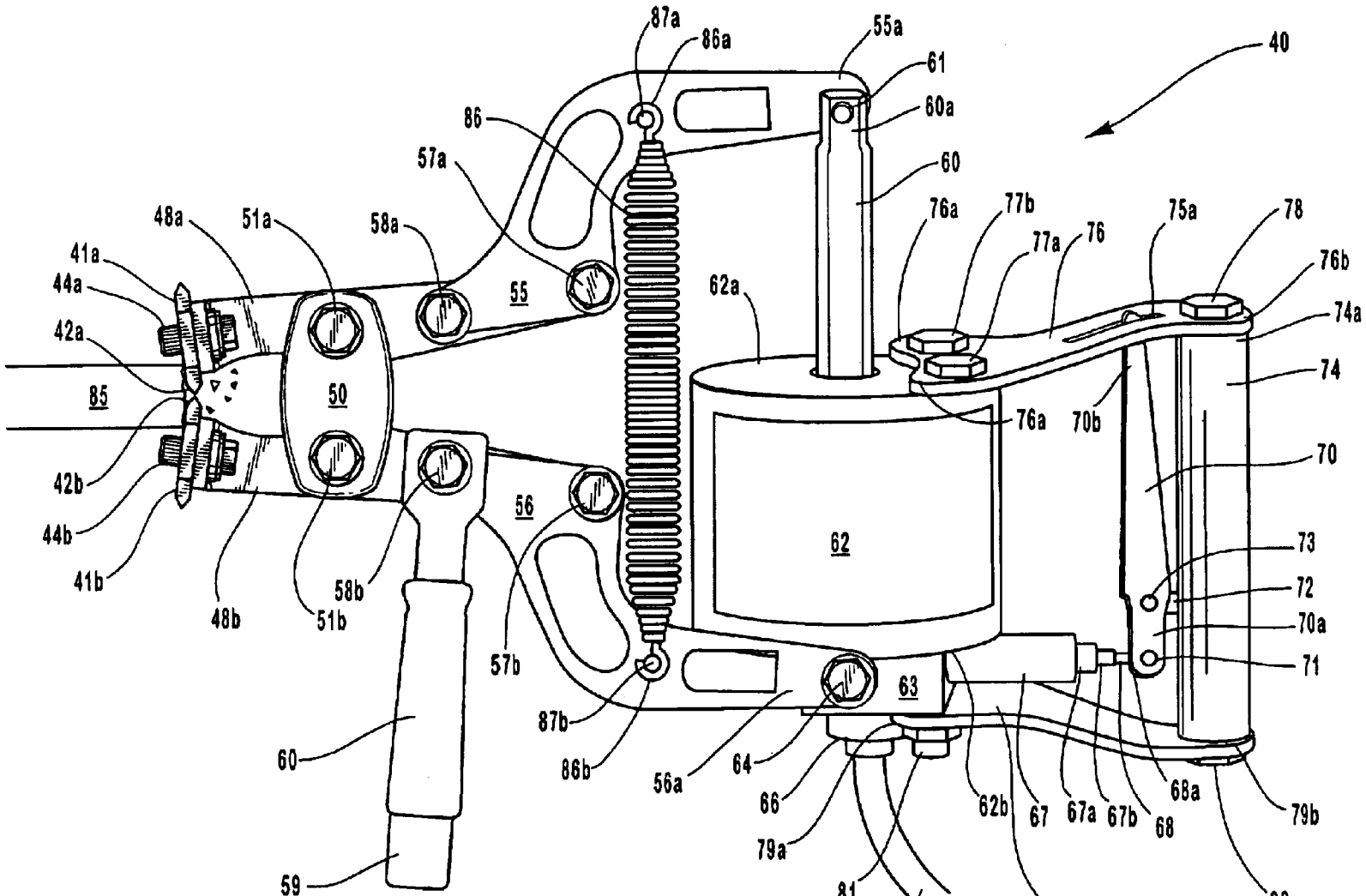
FIG. 10 shows the tool of FIG. 9 after air under pressure has been passed into the cylinder by operation of the tool trigger, that air flow acting against the piston to extend a rod to spread apart the scissoring arms and urge the nipping blade edges into contact, nipping through the edge of the section of marble or granite, as shown in FIG. 9.

The jaw mounting ends 29*a* and 29*b*, as shown best in FIG. 8, are secured, preferably by welding, across the undersurface of each of a pair of blade support plates 30*a* and 30*b* at their mid-sections, such that the blade plates form a T with the jaw mounting ends. The blade plates 30*a* and 30*b* are identical and, as shown in the exploded view of FIG. 7A, each blade plate includes one of a pair of like holes 36*a* that are each spaced apart equidistantly from the welded junction with the jaw mounting ends 29*a* and 29*b* and individually receive a threaded end of a bolt 32*a* that is first past through one of a pair of transverse slots 31*a* formed through the blade 14*a*, with the bolt end show aligned to receive a washer 35*a* and a lock washer 34*a* fitted thereover, with a nut 33*a* turned thereon, locking the blade onto a top surface of the blade plate 30*a*. So arranged, as shown in FIG. 8, the blades 14*a* and 14*b* can each be moved transversely across the top of blade support plates 30*a* and 30*b* for positioning the blades opposing edges 15*a* at an appropriate spacing distance therebetween. In practice, such spacing distance is selected for the particular edge width or thickness of a section of marble or granite 30. Each blade 14*a* is slid across the top face of blade plate, shown as support blade plate 30*a* in FIG. 7A, to where, with the tool jaws spread apart, as shown in FIG. 7, to a proper spacing distance between the opposing blade edges 15*a* and 15*b*. The blade edges 15*a* and 15*b* positioning is then maintained by the bolts 32*a* that are fitted through blade slots 31*a* and passed through the holes 36*a* to receive washers 35*a* and 34*a* fitted over and nuts 33*a* turned onto the bolts 32*a* threaded ends. The allow for positioning of the blades 14*a* and 14*b* to where their edges 15*a* and 15*b* are spaced appropriately apart to allow for passage of an edge of a section of marble or granite 39 between the opposing blade edges, as shown in FIG. 8. Whereafter, with closure together of the handles 11*a* and 11*b* ends 12*a* and 12*b*, the blade edges 15*a* and 15*b* close together, biting into the top and bottom marble or granite edge surfaces, and nipping off sections of marble or granite. In practice, the ability to select blade edges 15*a* and 15*b* spacing allows the tool to be used to nip or shear off sections or chips of marble or granite from a wide variety of thicknesses of marble and granite. Further, as shown in FIGS. 1, 2 3A 3B, 5, 6 and 8, the blades 14*a* and 14*b* each preferably include like blade edges 15*a* and 15*b*, respectively, that are formed to extend outwardly from along the blade parallel longitudinal edges. Which pair of blade edges 15*a* and 15*b* on each blade allows an operator, when the blade edge becomes dull, to dismount, turn and re-mount the blade 14*a* or 14*b* onto a blade plate 30*a* or 30*b* to position a sharp blade edge in opposition to the other blade edge.

Where the above described marble and granite nipping tool 10 is shown to be manually operated, a marble and granite nipping tool 40 that is power driven is shown in FIGS. 9 and 10. The marble and granite nipping tool 40 includes a same nipping end as that shown above for the marble and granite nipping tool 10, including: the double edge blades 41*a* and 41*b* having parallel edges 42*a* and 42*b*; blade plates 43*a* and 43*b*; blade support plates 30*a* and 30*b* that each include the center hole 36*a* and 36*b* that receive bolts 44*a* and 44*b* as have passed through each of spaced lateral slots holes formed through blades 42*a* and 42*b*. Which bolts 44*a* and 44*b* are also each passed through a washer 45*a* or 45*b*, a lock washer 46*a* or 46*b* and receive a nut 47*a* or 47*b* turned over a threaded end thereof. Similarly, nipper lever arms 48*a* and 48*b* are secured, as by welding, at their top ends 49*a* and 49*b* across the lateral centers of the undersurface of each blade plate 43*a* and 43*b*, forming right angles therewith. Which nipper lever arms 48*a* and 48*b* are pivotally connected, in spaced relationship, between straps 50 by bolts 5l*a* and 51*b* that are fitted therethrough and through aligned holes to receive nuts turned thereover. Similarly, like the nipper lever arms 24*a* and 24*b* of the marble and granite nipping tool 10, the nipper lever arms 48*a* and 48*b* rear portions or sections connect onto, respectively, upper and lower pneumatically driven extension arms 55 and 56, by bolts 57*a* and 57*b* and 58*a* and 58*b*, respectively, with bolt 58*a* shown as having been secured also through a forward handle 59 that has a hand grip 60. So arranged, the nipper lever arms 48*a* and 48*b*, that are individually secured to extension arms 55 and 56, are each free to pivot on bolts 51*a* and 51*b*, respectively, closing the opposing blades 41*a* and 41*b* together as the extension arms 55 and 56 are moved apart.

To provide which extension arms 55 and 56 outward movement, closing the opposing blades 41*a* and 41*b* together, and nipping off an edge of a section of marble or granite 85, as shown in FIGS. 9 and 10, is provided by a piston rod 60. The piston rod 60 is connected by a pivot 61at its end 60*a* to an end 55*a* of the extension arm 55.

The piston rod 60 is extended outwardly from a top surface 62*a* of a cylinder 62, the piston rod traveling from the attitude shown in FIG. 9 to that shown in FIG. 10. As shown, the cylinder 62 includes a manifold 63 secured to its bottom surface 62*b* and is connected by a pivot bolt 64 to an end 56*a* of the extension arm 56, and receives a pneumatic hose 65 fitting 66 turned therein. Which pneumatic hose 65 passes air under pressure through the fitting 66 and into the bottom cavity of the cylinder 62, below a piston, that acts upon to elevate the piston that the piston rod 60. So arranged, passage of air under pressure elevates the piston rod 60 and spreads the extension arms 55 and 56 apart to, in turn, close the opposing blades 41*a* and 42*b* together, nipping off an edge section of the section of marble or granite 59, as shown in FIG. 10. For controlling air passage into a valve is included in the manifold 63 having a cylinder 67 that extends outwardly from the manifold and includes a pressure fitting 67*a* on the end thereof that is fitted with a seal 67*b* and receives a trigger rod 68 longitudinally fitted therein. The trigger rod 68 is to travel back and forth to open the manifold valve to pass air under pressure into the cylinder 62 when the trigger piston 68 is urged into the cylinder 67, extending the piston rod 60, as shown in FIG. 10. Air flow is closed off when the trigger piston 68 is retracted to the attitude shown in FIG. 9. Which trigger piston 68 travel is provided by a trigger 70 having a trigger end 70*a* that is connected by a pivot pin 71 to a trigger 68 end 68*a* and, spaced therefrom, is a trigger pivot arm 72 that includes a trigger pivot pin 73. The trigger pivot pin 73 is fitted through the trigger 70 and provides a fulcrum to the trigger whereby, when the trigger is pulled towards a handle 74, the lower trigger end 70*a* pivots the trigger end 68*a* of the connected trigger piston 68 into the cylinder 67, opening the pressure valve within the manifold 63. To guide trigger 70 movement, the upper trigger end 70*b* is fitted to travel in a slot 75 formed in an upper handle mounting bracket 76. Which handle mounting bracket 76 connects, at one end 76*a*, by bolts 77*a* and 77*b* onto top surface 62*a* of cylinder 62, and is mounted by a bolt 78, at its opposite end 76*b*, onto a handle 74 end 74*a*. The opposite handle 74 end 74*b* is secured to an end 79*b* of a lower bracket 79 by a bolt 80, with the other lower bracket end 79*a* maintained to the manifold 63 lower surface by a bolt 81. So arranged, an operator gripping in one hand the grip 60 of forward handle 59, and holds the handle 74 in their other hand, and with their finger on trigger 70, can pull on that trigger to pass air under pressure through line 65 that acts of the piston within cylinder 62 to extend the piston rod 60, as shown in FIG. 10. The blades 41*a* and 41*b* are thereby closed together, nipping off an edge portion of a section of granite or marble 85. With release of trigger 70, an air flow into cylinder 62 is cut off, allowing the piston rod 60 to retract into the cylinder 62. Which piston rod 60 retraction is encouraged by a coil spring 86 that is secured at its hook ends 86*a* and 86*b*, respectively, to posts 87*a* and 87*b* that extend, respectively out from the faces of the extension arms 55 and 56, and is stretched when the extension arms are spread apart. Upon removal of air pressure from the piston within the cylinder 62, the stretched coil spring 86 retracts, drawing its coils together, and returns the extension arms 55 and 56 back to the attitude shown in FIG. 9. In operation, an operator needs only to appropriately position the opposing blades 41*a* and 41*b* over the marble or granite 85 edges, shown in FIG. 9, and pulls the trigger 70. The opposing blades are then closed together, nipping off a section of the granite or marble section 85, as shown in FIG. 10. With, upon release of the trigger 70, the coil spring 86 pulls the extension arms 55 and 56 back to their attitude shown in FIG. 9. Whereat, the opposing blades 41*a* and 41*b* can be reposition over a marble or granite section edge.

In practice, while the opposing blades 14*a* and 14*b* and 41*a* and 41*b* of both embodiments 10 and 40 can be positioned onto the opposing flat surfaces at a section of marble or granite edge and the blades closed together as described to nip off a portion of the edge, an operator may scribe aligned grooves or slots is the opposite marble or granite faces, proximate to the edge, to facilitate blade 41*a* and 41*b* positioning, within the scope of this disclosure. Also, while manual and pneumatical operated handle arrangements have been shown herein, it should be under stood that other closing arm arrangements could be so employed, within the scope of this disclosure.

While preferred embodiments of my invention in marble and granite edge nipping tool have been shown and described herein, it should be understood that the present disclosure is made by way of example only and that variations and changes are possible without departing from the subject matter and reasonable equivalency thereof coming within the scope of the following claims, which claims I regard as my invention.

I claim:

1. A marble and granite edge nipping tool comprising, a pair of jaws each having a like blade mounting end that each consists of a blade support plate formed with a pair of identical center holes formed at like distances from a center of each said blade support plate, and including ends of a pair of like lever arms that are each secured to extend across said center of an undersurface of each said blade support plate, forming right angles, and said lever arms are pivotally connected together at their mid-portions and include coupling ends that receive a means for spreading apart and closing together said coupling ends; a scissoring means for coupling to said coupling ends of said lever arms to, when operated by an operator, provide a force to close said lever arms blade support plates edges together; a pair of identical nipping blades each consisting of a flat rectangular section formed from a stiff metal and includes nipping edges formed along opposing long edges, and a pair of transverse slots formed at spaced locations across said rectangular flat section longitudinal axis and are equidistant from said rectangular flat section middle and each said transverse slot receives a bolt fitted therethrough that passes also through one of said pair of holes formed in each said blade support plate, and which said bolt ends are treaded to receive nuts turned thereover, for locking each said nipping blade onto a blade mounting where said nipping blades nipping edges are parallel to one another and spaced a desired distance apart to nipping a selected thickness of an edge of a section of marble or granite.

2. The marble and granite nipping tool as recited in claim 1, wherein the blade support plates are each like flat plates with undersurfaces of each to receive a lever arm upper end secured across said flat blade support plate transverse center, forming a T; and metal straps are fitted across opposite faces of said lever arms mid-portions that receive bolts fitted through aligned holes formed in said lever arms mid-portions and through said metal strap ends, and with nuts turned over said bolts ends, pivotally coupling said lever arms.

3. The marble and granite nipping tool as recited in claim 1, wherein the scissoring means include, as forward ends, a pair of leverage bar means that each connect, on a forward end of each, to one each of the pair of lever arms and include means for spreading apart and closing together which said leverage bar means forward ends.

4. The marble and granite nipping tool as recited in claim 3, wherein the pair of leverage bar means each includes one forward end that includes a pivot and with the other of said forward ends ending in a crank, with a combination of a pivot and crank ends to fit over and sandwich therebetween each of the ends of the lever arms, and with other ends of said cranks to align and each receives a fastener means fitted therethrough as a movable pivot, wand which said movable pivot will travel from rear to forward positions as rear ends of said pairs of bars are moved together and apart.

5. The marble and granite nipping tool as recited in claim 4, further including a pair of straight scissoring arms each having a forward that is connected to one of the pairs of bars and includes a handle means fitted over rear end portions of each, and each said handle means is for gripping by an operator for moving said scissoring arms together and apart.

6. The marble and granite nipping tool as recited in claim 5, wherein blade stop means consisting of opposing tabs are secured to said pairs of bars rear ends in opposing relationship, that contact to limit travel of said pairs of bars rear ends together, controlling the distance of closure of the blade mounting ends of the lever arms.

7. The marble and granite nipping tool as recited in claim 3, wherein the scissoring means include, as the leverage bar means, a pair of extension arms having forward ends that are each rigidly coupled to each of the pair of lever arms and having mid to rear portions thereof fitted between a spring return, pneumatic cylindrical body and piston rod, which said piston rod, when extended outwardly from a top of said cylindrical body, upon receipt of an air flow under pressure directed into said cylindrical body, spreads apart said extension arms rear ends, with said spring return to bias said extension arms rear ends into a closed attitude, and retract said piston rod back into said cylindrical body the flow of air under pressure into said cylindrical body is discontinued.

8. The marble and granite nipping tool as recited in claim 7, wherein the spring return is a coil spring having ends that are, respectively, each connected to one of a pair aligned pins that each extend outwardly from mid-portions of each of the extension arms.

9. The marble and granite nipping tool as recited in claim 7, wherein the cylindrical body includes a movable piston fitted to travel therein and mounts the piston rod that extends out from the center thereof, at a right to an upper surface of said movable piston, and said piston rod is pivotally connected at its top end to an upper extension arm rear end.

10. The marble and granite nipping tool as recited in claim 9, wherein a bottom end of said cylindrical body is rigidly connected to a bottom extension arm rear end and includes a manifold that is ported into said cylindrical body, opening below the movable piston, and said manifold includes a connector for coupling to a fitting whereto is connected a hose for passing air under pressure; and valve means arranged with said manifold that includes a means for opening said valve means to pass and shut off a flow of air under pressure into said manifold that flows into said cylindrical body.

11. The marble and granite nipping tool as recited in claim 10, further including a handle means for connection to, to extend rearwardly from, the top surface of the cylindrical body and the a bottom surface of said manifold; and a trigger means is arranged with said handle means for operation by an operator who pulls and releases said trigger to, respectively, open and close the valve means.

* * * * *